US012545548B2

(12) United States Patent
Lozhko

(10) Patent No.: US 12,545,548 B2
(45) Date of Patent: Feb. 10, 2026

(54) SPOOL FOR PREVENTING TIPPING OF THE SPOOL DURING PAYOUT OF CABLE

(71) Applicant: PPC BROADBAND, INC., East Syracuse, NY (US)

(72) Inventor: Andriy Lozhko, Syracuse, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 395 days.

(21) Appl. No.: 17/901,723

(22) Filed: Sep. 1, 2022

(65) Prior Publication Data

US 2023/0073571 A1 Mar. 9, 2023

Related U.S. Application Data

(60) Provisional application No. 63/239,533, filed on Sep. 1, 2021.

(51) Int. Cl.
*B65H 75/24* (2006.01)
*B65H 75/14* (2006.01)
*B65H 75/22* (2006.01)

(52) U.S. Cl.
CPC ..... *B65H 75/24* (2013.01); *B65H 75/14* (2013.01); *B65H 75/2245* (2021.05); *B65H 2701/50* (2013.01)

(58) Field of Classification Search
CPC ..... B65H 49/321; B65H 75/2209
USPC ..... 242/406
See application file for complete search history.

(56) References Cited

U.S. PATENT DOCUMENTS 2,182,936 A * 12/1939 Whittaker ..... B65H 75/18 242/403
2,602,604 A * 7/1952 Russell ..... A63H 27/002 242/406
2,946,535 A * 7/1960 Marion ..... B65H 67/00 242/607
3,836,059 A * 9/1974 Lauen ..... B65H 75/32 242/125.2
7,066,425 B2 * 6/2006 Cornier ..... B65H 75/18 188/30
7,938,356 B2 * 5/2011 Taatjes ..... B29C 64/118 242/125.3
8,272,591 B2 * 9/2012 Baranov ..... B65H 75/2245 242/608.5

(Continued)

*Primary Examiner* — William A. Rivera
(74) *Attorney, Agent, or Firm* — MH2 TECHNOLOGY LAW GROUP LLP

(57) ABSTRACT

A spool includes a receiving portion configured to receive a coil of cable and a first retaining portion and a second retaining portion configured to retain the coil of cable on the receiving portion. A portion of an outer peripheral surface of the first retaining portion and a portion of an outer peripheral surface of the second retaining portion are configured to engage a ground surface. The first retaining portion includes first support portions configured to extend beyond the outer peripheral surface of the first retaining portion to engage the ground surface across a greater distance than the outer peripheral surface of the first retaining portion, and the second retaining portion includes second support portions configured to extend beyond the outer peripheral surface of the second retaining portion to engage the ground surface across a greater distance than the outer peripheral surface of the second retaining portion.

34 Claims, 10 Drawing Sheets

(56) References Cited

U.S. PATENT DOCUMENTS

| | | | | |
|---|---|---|---|---|
| 9,062,459 | B2 * | 6/2015 | Berkowitz | E04D 5/02 |
| 2005/0006276 | A1 * | 1/2005 | Thiessen | B65H 75/4471 206/702 |
| 2017/0036884 | A1 * | 2/2017 | Cox | B65H 49/324 |

* cited by examiner

FIG. 3B
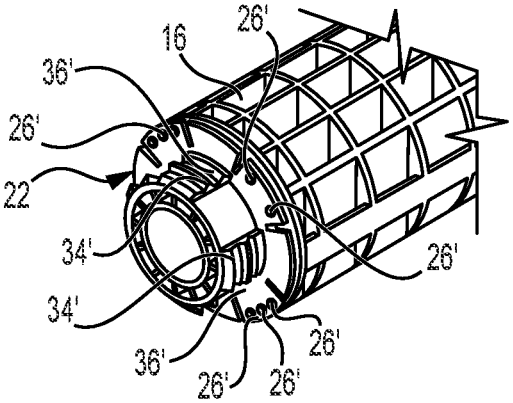
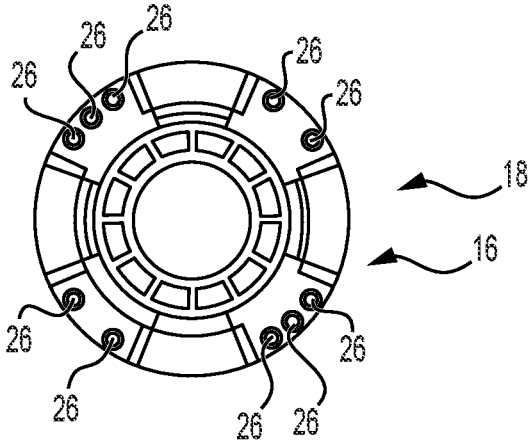
FIG. 3A
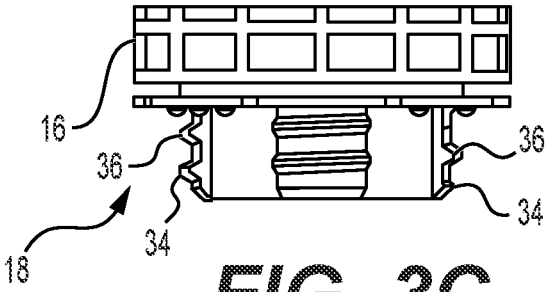
FIG. 3C
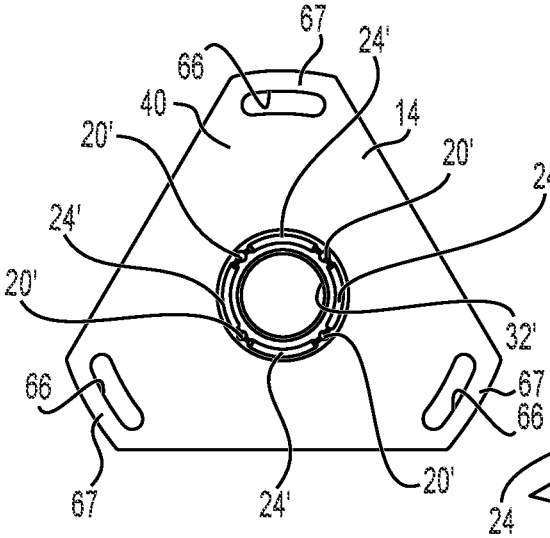
FIG. 4
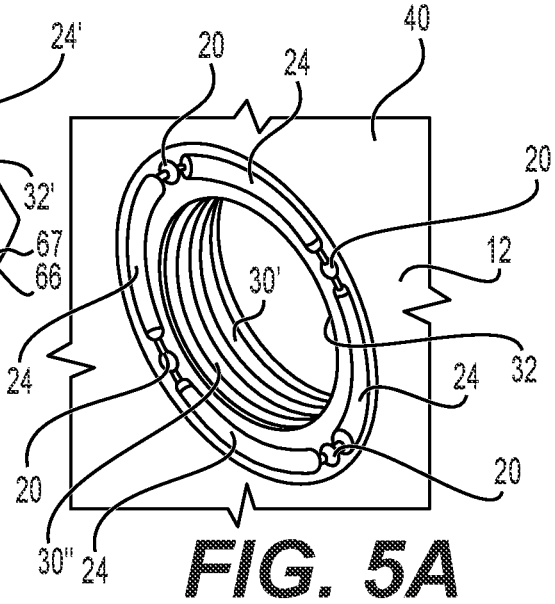
FIG. 5A

SPOOL FOR PREVENTING TIPPING OF THE SPOOL DURING PAYOUT OF CABLE

CROSS-REFERENCE TO RELATED APPLICATION

This application claims the benefit of U.S. Provisional Application No. 63/239,533, filed Sep. 1, 2021, the disclosure of which is hereby incorporated by reference herein in its entirety.

TECHNICAL FIELD

The present disclosure generally relates to equipment for installing cable into structures, and more particularly relates to spools for receiving a reel of cable and preventing tipping of the spool during payout of the cable from the reel.

BACKGROUND

The process of installing cable (e.g., coaxial cable, fiber optic cable, category cable, electrical wiring cable, and the like) into structures, for example, new homes, is relatively time consuming, and can lead to frustrating entanglements or other shortcomings in the distribution of the cable. For example, cable is often provided from the manufacturer in the form of a wound coil, with a simple plastic wrapping therearound. The electrician installing the cable into the building or structure is required to remove the plastic wrapping and pull an end of the cable to begin installation. This can result in the coil itself being pulled with the cable such that it is not readily distributed. Many electricians therefore are required to produce or fabricate some sort of axle or mandrel about which the coil may rotate. This can be frustrating to the electrician, and necessarily results in slower installation times.

Alternatively, cable coils are sometimes provided within cardboard boxes. The cardboard boxes are typically provided with a scored area which must be removed such that the electrician can reach in and grab an end of the cable to begin the installation process. However, this can also be frustrating and slow in that the cardboard box will tend to be pulled with the cable. It would be advantageous if the cable were to be provided on a drum adapted for rotation, but such drums are often not provided by the manufacturer for cost reasons.

It may be desirable to provide a spool configured with improved stability so as to prevent the spool from tipping during payout of the cable. It may be desirable to provide a spool that allows manufacturers to continue to provide coils either within the aforementioned plastic wrapping or cardboard box, and still enable a technician to readily, and repeatedly, mount the coil for rotation. It may also be desirable to provide a spool configured to raise the coil of cable away from the ground surface to provide additional clearance for payout of the cable from the coil.

SUMMARY

In accordance with a first exemplary embodiment of the disclosure, a reusable spool for receiving a coil of cable and preventing tipping of the spool during payout of the cable from the coil includes a cylindrical drum having a first end and a second end, a first flange configured to be removably coupled with the first end of the drum, and a second flange configured to be removably coupled with the second end of the drum. The reusable spool also includes a first pair of legs movingly coupled with the first flange between a stowed position, where the first pair of legs are disposed within an outer periphery of the first flange, and a deployed position, where the first pair of legs are configured to extend beyond the outer periphery of the first flange, and a second pair of legs movingly coupled with the second flange between a stowed position, where the second pair of legs are disposed within an outer periphery of the second flange, and a deployed position, where the second pair of legs are configured to extend beyond the outer periphery of the second flange. The first flange and the second flange are configured to be removed from the drum to permit the drum to receive a coil of cable and to be coupled with the drum to retain the coil on the drum, the cylindrical drum is configured to receive the coil of cable and to permit the coil of cable to rotate relative to the cylindrical drum, the first flange, and the second flange, and a portion of an outer peripheral surface of the first flange and a portion of an outer peripheral surface of the second flange are configured to engage a ground surface over a first distance when the first pair of legs and the second pair of legs are in the stowed position. The first pair of legs and the second pair of legs are configured to be moved to the deployed position to raise the drum, the first flange, and the second flange away from the ground surface to provide additional clearance for payout of the cable from the coil and to engage the ground surface over a second distance that is greater than the first distance to improve stability of the reusable spool so as to prevent the spool from tipping during payout of the cable.

In accordance with a second exemplary embodiment of the disclosure, spool for receiving a coil of cable and preventing tipping of the spool during payout of the cable from the coil includes a receiving member configured to receive a coil of cable and having a first end and a second end, a first retaining member configured to be coupled with the first end of the receiving member, and a second retaining member configured to be coupled with the second end of the receiving member. The spool also includes a first pair of support members movingly coupled with the first retaining member between a stowed position, where the first pair of support members are disposed within an outer periphery of the first retaining member, and a deployed position, where the first pair of support members are configured to extend beyond the outer periphery of the first retaining member, and a second pair of support members movingly coupled with the second retaining member between a stowed position, where the second pair of support members are disposed within an outer periphery of the second retaining member, and a deployed position, where the second pair of support members are configured to extend beyond the outer periphery of the second retaining member. The first retaining member or the second retaining member is configured to be removed from the receiving member to permit the receiving member to receive a coil of cable, and a portion of an outer peripheral surface of the first retaining member and a portion of an outer peripheral surface of the second retaining member are configured to engage a ground surface across a first distance when the first pair of support members and the second pair of support members are in the stowed position. The first pair of support members and the second pair of support members are configured to be moved to the deployed position to engage the ground surface across a second distance that is greater than the first distance to improve stability of the reusable spool so as to prevent the spool from tipping during payout of the cable.

In accordance with a third exemplary embodiment of the disclosure, a spool for receiving a coil of cable and preventing tipping of the spool during payout of the cable from the coil includes a receiving portion configured to receive a coil of cable and a first retaining portion and a second retaining portion configured to retain the coil of cable on the receiving portion. A portion of an outer peripheral surface of the first retaining portion and a portion of an outer peripheral surface of the second retaining portion are configured to engage a ground surface. The first retaining portion includes first support portions configured to extend beyond the outer peripheral surface of the first retaining portion to engage the ground surface across a greater distance than the outer peripheral surface of the first retaining portion, and the second retaining portion includes second support portions configured to extend beyond the outer peripheral surface of the second retaining portion to engage the ground surface across a greater distance than the outer peripheral surface of the second retaining portion.

BRIEF DESCRIPTION OF THE DRAWINGS

Further advantages and features of the present disclosure will become apparent from the following description and the accompanying drawings, to which reference is made. In which are shown:

FIG. 3A is an end view of a first end of the drum in FIG. 2.

FIG. 3B is a partial isometric view of a second end of the drum of FIG. 2.

FIG. 3C is a top partial view of the first and/or second end of the drum of FIG. 2.

FIG. 4 is a side view of the second flange of FIG. 2.

FIG. 5A is an enlarged view of the opening of the first flange of FIG. 2.

DETAILED DESCRIPTION

Figure 1:
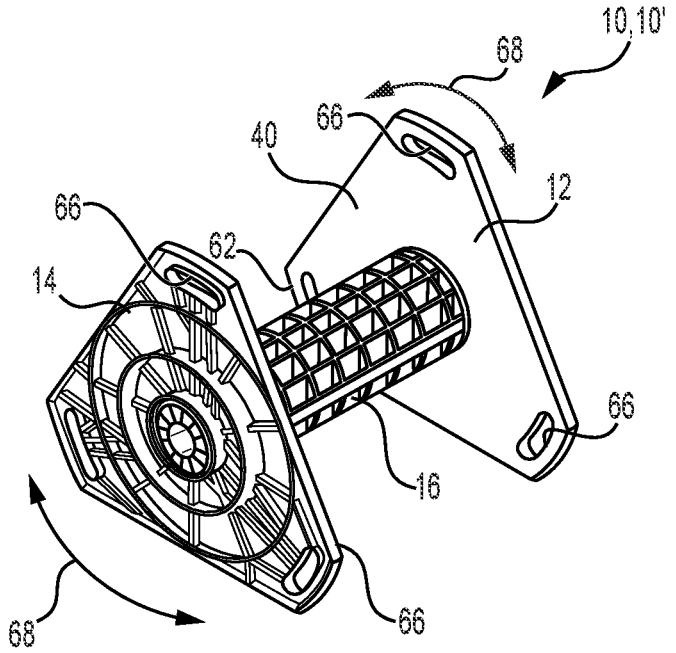
FIG. 1 is an isometric view of a first and second exemplary embodiment of the present disclosure.
Figure 2:
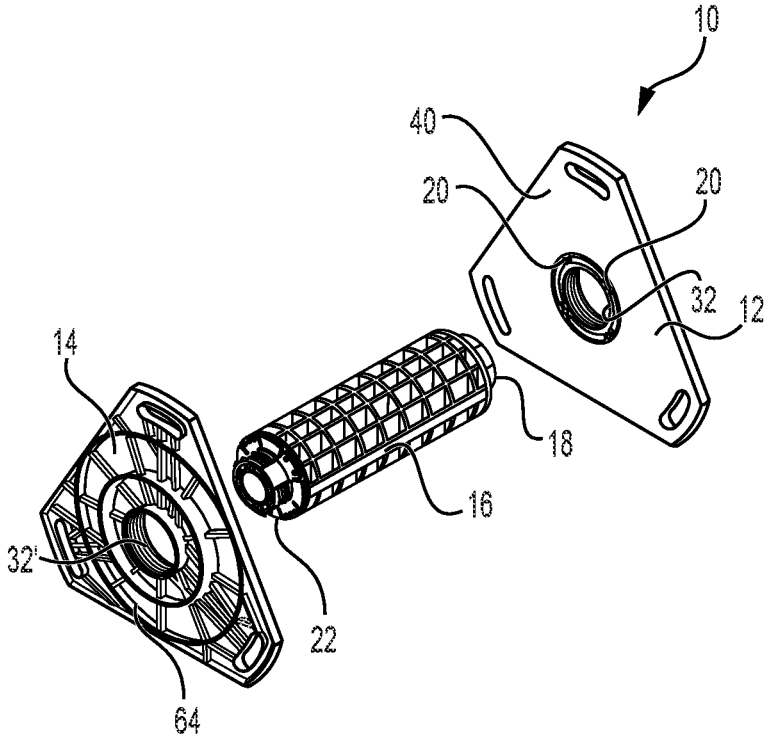
FIG. 2 is an expanded view of a first embodiment of the present disclosure.

Reference will now be made in detail to embodiments and methods of the present disclosure, which constitute the best modes of practicing the present disclosure presently known to the inventors. However, it is to be understood that the disclosed embodiments are merely exemplary of the present disclosure that may be embodied in various and alternative forms. Therefore, specific details disclosed herein are not to be interpreted as limiting, but merely as a representative basis for any aspect of the present disclosure and/or as a representative basis for teaching one skilled in the art to variously employ the present disclosure.

It is also to be understood that this present disclosure is not limited to the specific embodiments and methods described below, as specific components and/or conditions may, of course, vary. Furthermore, the terminology used herein is used only for the purpose of describing particular embodiments of the present disclosure and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

With reference to FIGS. 1-7, in a first embodiment of the present disclosure, a spool 10, for example, a reusable spool, may include a first retaining portion 12, for example, a flange, a second retraining portion 14, for example, a flange, and a receiving portion 16, for example, a drum, configured to be disposed between the first flange 12 and the second flange 14. The first flange 12 may define a plurality of first retaining features 20, for example, first recesses 20. The second flange 14 may define a plurality of second retaining features, for example, second recesses 20'. The drum 16 may define a plurality of engagement structure 26, for example, projections or nubs, at a first end 18 of the drum 16 and at a second end 22 of the drum 16. The plurality of nubs 26 at the first end 18 of the drum 16 may be configured to be disposed in the plurality of first recesses 20 defined on the first flange 12. The plurality of nubs 26 at the second end 22 of the drum 16 are configured to be disposed in the plurality of second recesses 20' of the second flange 14.

Referring to FIG. 5A, the first flange 12 of this exemplary reusable spool 10 may include one or more first engagement features 24, for example, first channels, in the first flange 12, and the second flange 14 of this exemplary reusable spool 10 may define one or more second engagement features 24', for example, second channels 24', as shown in FIG. 4. The first channels 24 may be defined in the first flange 12 between each of the first recesses 20 of the plurality of first recesses 20, as best illustrated in FIG. 5A. The second channels 24' may be defined in the second flange 14 disposed between each of the second recesses 20' in the second flange 14, as shown in FIG. 4. The nubs 26 at the first end 18 of the drum 16 are configured to slide in the first channels 24, and the nubs 26 at the second end 22 of the drum 16 are configured to slide in the second channel 24'.

When at least two of the nubs 26 at each of the first end and the second end of the drum 16 are engaged with or disposed in a corresponding recess 20, 20' defined in a one of the first or second flanges 12, 14, the rotational position of the drum 16 is fixed relative to the position of each of the first and second flanges 12, 14 during payout of cable from a reel of cable (not shown) disposed on the drum 16. For example, as shown in FIG. 3A, each of the first and second ends 18, 22 of the drum 16 may include four groups of projections 26 space apart circumferentially proximate the periphery of the drum 16. In the exemplary embodiment, two diametrically opposed groups of projections include three projections 26 and the other two diametrically opposed groups include two projections 26. When the center projections of the groups of three projections 26 are received in the recesses 20, 20', the two outer projects of the groups of three projections 26 are received in the channels 24, 24' on each side of the recesses 20, 20', and the two projections of the groups of two projections are received in the channels on each side of the two remaining recesses that do not receive a projection. As a result, the rotational position of the drum 16 is fixed relative to the position of each of the first and second flanges 12, 14 during payout of cable from a reel of cable (not shown) disposed on the drum 16.

Typically, the reel of cable includes cable that is wound onto a cylinder, for example, a cardboard cylinder. When the reel is received on the drum, the reel is free to rotate relative to the drum to payout cable from the reel.

Figure 5B:
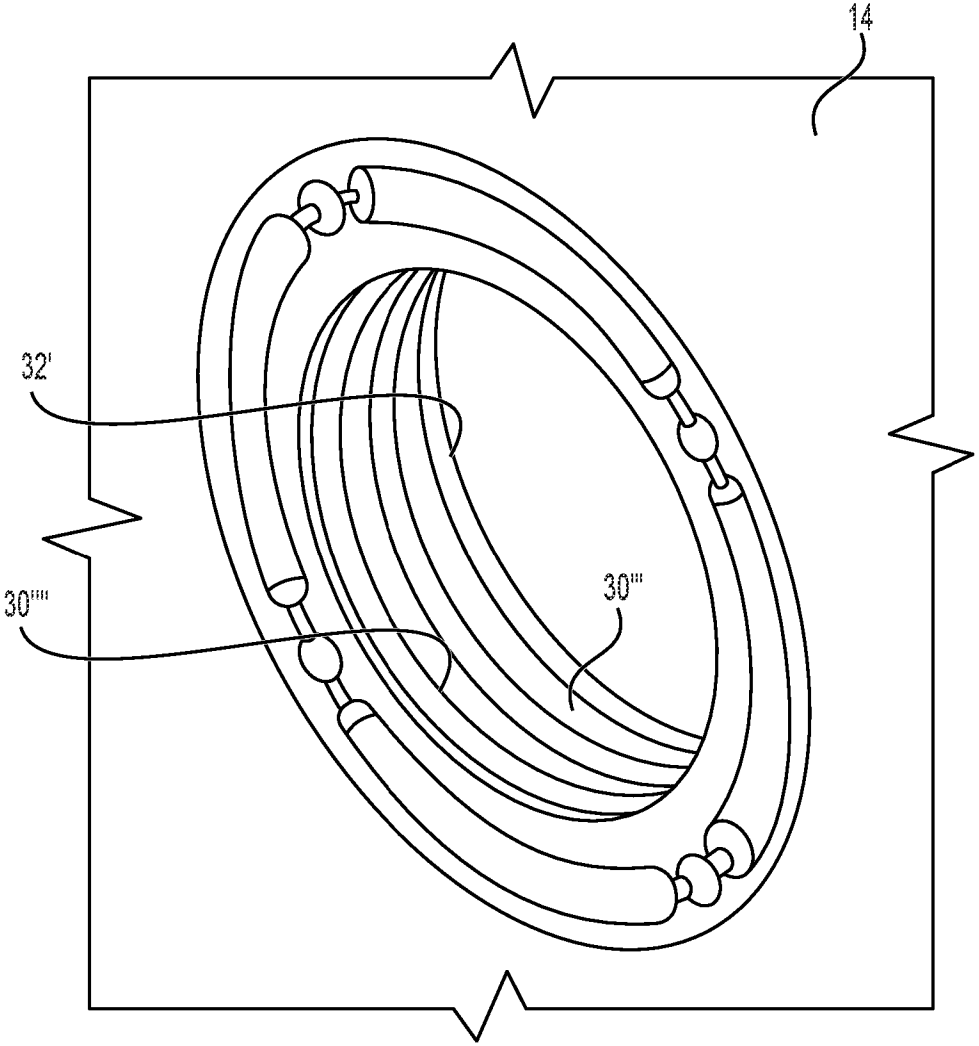
FIG. 5B is an enlarged view of the opening of the second flange of FIG. 2.
Figure 7:
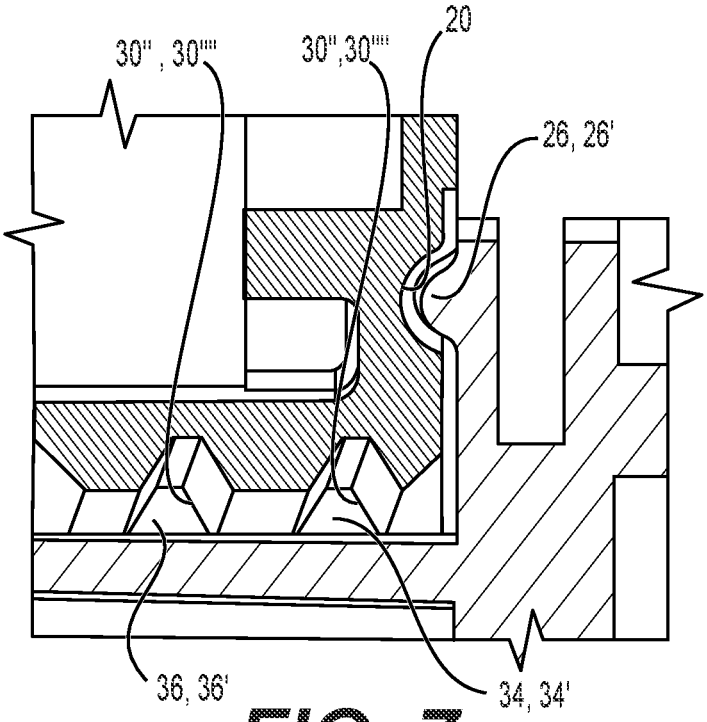
FIG. 7 is a cross-sectional view which represents each end of the drum as it engages with the flange in various embodiments of the present disclosure.

Referring to FIGS. 4 and 5A, in this exemplary embodiment, the first flange 12 and the second flange 14 may each define a receiving feature 32, 32', for example, an opening. The first flange 12 of this exemplary embodiment of the reusable spool 10 may also define one or more grooves 30', 30" in the opening 32 defined by the first flange 12. The second flange 14 may also define one or more second grooves 30''', 30'''' in the opening 32' defined by the second flange 14. The grooves 30', 30" and the second groove 30''', 30'''' are configured to receive corresponding engagement structures 34, 34', for example, tabs, defined at each end of the drum 16, as shown in FIG. 7. For example, one or more tabs 34 may be defined at the first end 18 of the drum 16, as shown in FIG. 3C, and one or more second primary tabs 34' may be defined at the second end 22 of the drum 16, as shown in FIG. 3B. Thus, as shown in FIG. 5A, the first flange 12 may define a groove 30' and an optional second groove 30" in the opening 32 of the first flange 12. The second flange 14 may define a groove 30''' and an optional second groove 30'''' in the opening 32' of the second flange 14, as shown in FIG. 5B.

When the first flange 12, the drum 16 and the second flange 14 are assembled, the tab 34 at the first end of the drum 16 may be configured to be at least partially disposed in the groove 30' defined on the first flange 12, and a second tab 36, if implemented, of the drum 16 may be configured to be disposed in a second groove 30" defined on the first flange 12. The tabs 34' at the second end 22 of the drum 16 may be configured to be disposed in the groove 30''' of the second flange 14 and the second tab 36', if implemented, at the second end 22 of the drum 16 may be configured to be at least partially disposed in the second groove 30'''' of the second flange 14.

During connection of the drum 16 with the flanges 12, 14, the drum 16 is configured to rotate relative to the flanges 12, 14, and the tabs 34, 36 are configured to slide in their corresponding grooves 30', 30", 30''', 30''''. Moreover, the tabs 34, 36 at the first end 18 of the drum 16 also secure the first end 18 of the drum 16 within the opening 32 of the first flange 12 up to a predetermined lateral force 78, and the tabs 34', 36' at the second end 22 of the drum 16 secure the second end 22 of the drum 16 within the opening 32' of the second flange 14. However, it is understood that this spool 10 may be reused because either or both of the first and second flanges 12, 14 may be removed from the drum 16 to mount yet another coil of cable onto the drum 16 by exceeding the predetermined lateral force 78 by overcoming the engagement force/connection between the tabs 34, 34', 36, 36' and the grooves 30', 30", 30''', 30''''. Of course, the removed flanges 12, 14 may be mounted onto the drum again by pushing the correspond end of the drum 16 into the opening 32, 32' of the flange 12, 14 once the new/next coil of cable is mounted onto the drum 16.

With reference to FIGS. 1 and 10, in yet another exemplary embodiment of the present disclosure, a reusable spool 10' may include a first flange 12, a second flange 14, and a drum 16 which is configured to be disposed between the first flange 12 and the second flange 14. In this example, the first flange 12 defines one or more first nubs 26, and the second flange 14 defines one or more second nubs 26', as shown in FIG. 5D. Each nub 26, 26' may be a protrusion defined by each flange 12, 14 and each nub 26, 26' may be proximate to an opening 32 , 32' of each flange 12, 14. As shown in FIG. 5D, each nub 26,26' may be formed on an inner surface 40 of each flange 12, 14. As shown in FIG. 5D, the first flange 12 may define an opening 32 (which may be in the form of a recess or an aperture) which is configured to receive a first end 18 of the drum 16. Also, as shown the second flange 14 defines an opening 32' (which may be in the form of a recess or an aperture) which is configured to receive a second end 22 of the drum 16.

Figure 6:
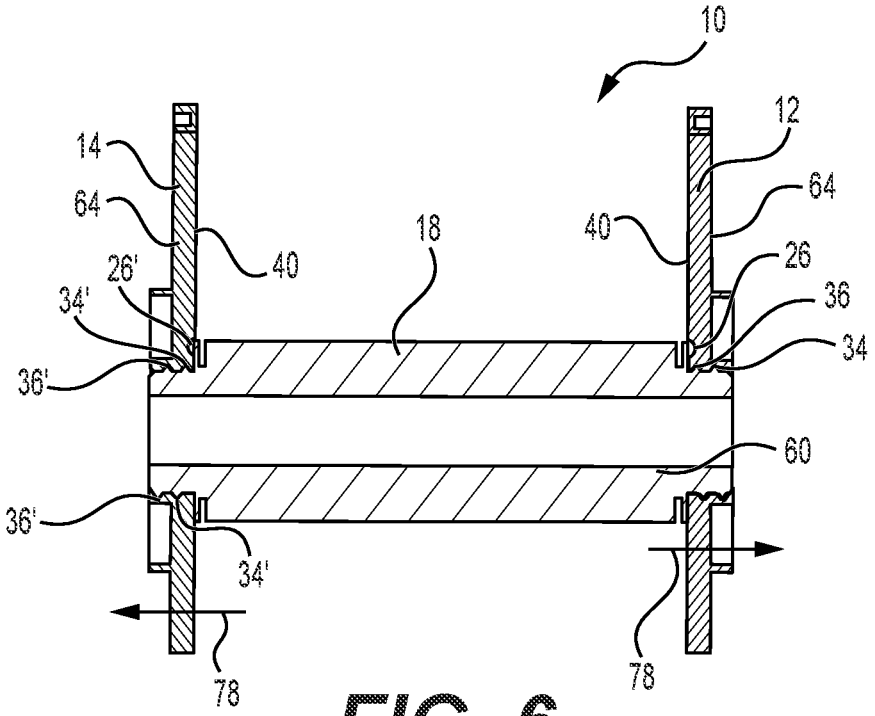
FIG. 6 is a cross-sectional view of the first embodiment of the present disclosure shown in FIG. 1.

Referring now to FIGS. 6 and 7, the drum 16 may define one or more recesses 20, 20' at a first end 18 of the drum 16 and at a second end 22 of the drum 16, wherein the recesses 20, 20' are configured to receive the corresponding nubs 26, 26' in the recesses 20, 20'. The nubs 26 of the first flange 12 are configured to be at least partially disposed in the corresponding first recesses 20 defined at the first end 18 of the drum 16. The plurality of nubs 26' of the second flange 14 are also configured to be at least partially disposed in the corresponding second recesses 20' defined at the second of the drum 16. When the drum 16 is assembled with the first and second flanges 12, 14 as shown, the engagement of each nub 26, 26' in its corresponding recess maintains the rotational position of the drum 16 relative to the flanges 12, 14 up to a certain predetermined rotational force 68. Once the predetermined rotational force 68 has been exceeded, each nub 26, 26' may slide out of its corresponding recess 20, 20' into an adjacent channel 24, 24' until each nub 26, 26' is moved into and at least partially disposed in another nub 26, 26' at the other end of the channel 24, 24'.

Figure 5C:
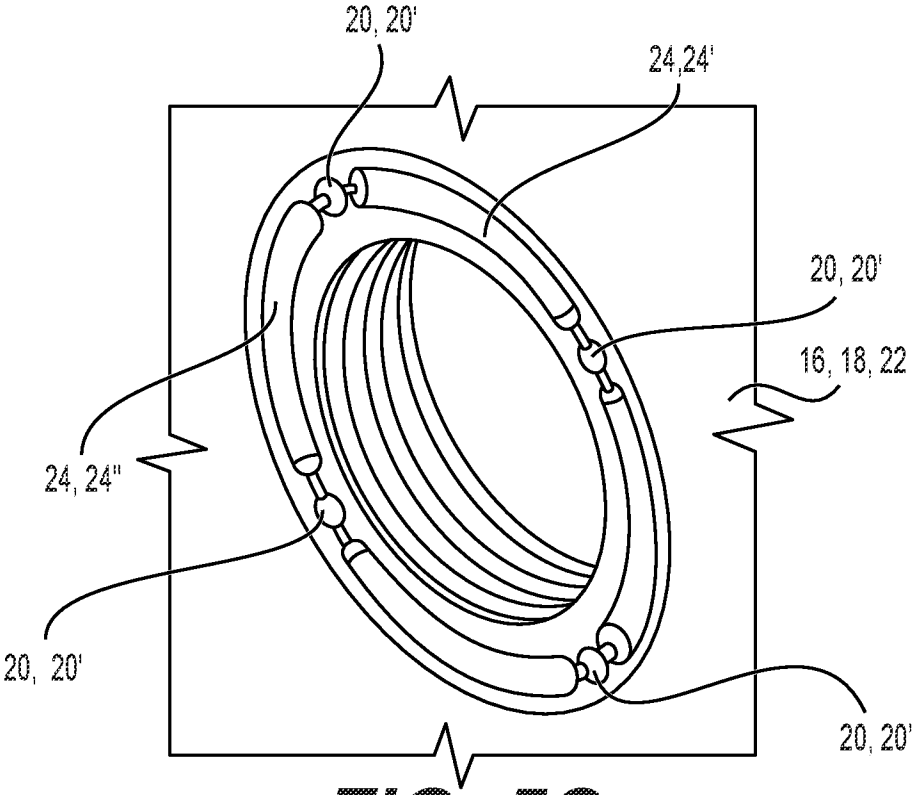
FIG. 5C is an enraged view of an end of the drum in a second embodiment of the present disclosure.
Figure 5D:
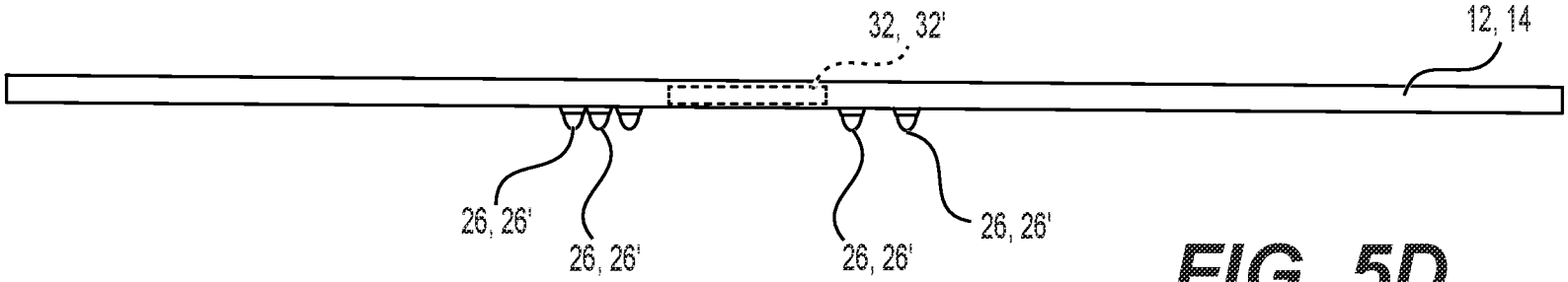
FIG. 5D is a top view of a flange in the second embodiment of the present disclosure where the nubs are defined on each flange.

Therefore, as shown in FIG. 5C and 5D, it is understood that when the first flange 12 defines a plurality of nubs 26, there may be one or more channels 24 defined in the drum 18 between each pair of recesses 20. Similarly, when the second flange 14 defines a plurality of nubs 26', there may be one or more channels 24' defined at the second end 22' of the drum 18 between each pair of recesses 20'. The arrangement between the nubs 26, 26', the channels 24, 24' and the recesses 20, 20' enables a stepped rotation of the drum 16 relative to the flanges 12, 14 during connection of the drum 16 with the flanges 12, 14.

In this exemplary embodiment and similar to the previous embodiments, the opening 32 of the first flange 12 may also define a groove 30' and an optional second groove 30", and the opening 32' of the second flange 14 may also define a groove 30''' and an optional second groove 30''''. Also, the drum 16 may include an optional second tab 36 defined at the first end 18 of the drum 16 and an optional tab second tab 36' defined at the second end 22 of the drum 16.

When the first and second flanges 12, 14 are assembled onto to drum 16, the tab 34 at the first end of the drum 16 is configured to be at least partially disposed in the groove 30' defined on the first flange 12 and the second primary tab 34" at the second end 22 of the drum 16 is configured to be at least partially disposed in the groove 30'" of the second flange 14 (see exemplary tab 34, 36 and groove 30 arrangement in FIG. 7). When implemented, the optional second tab 36 at the first end of the drum may also be configured to be at least partially disposed in the second groove 30" defined on the first flange 12 and the optional second tab 36' at the second end 22 of the drum 16 is configured to be at least partially disposed in the second groove 30"" of the second flange 14.

During connection of the drum 16 with the flanges 12, 14, when the drum 16 rotates relative to the flanges 12, 14, the tabs 34, 34', 36, 36' are configured to slide in their corresponding grooves 30', 30", 30'", 30"". Moreover, similar to the previous embodiment, the tabs 34, 36 at the first end 18 of the drum 16 also secure the first end 18 of the drum 16 within the opening 32 of the first flange 12 up to a predetermined lateral force, and the tabs 34', 36' at the second end 22 of the drum 16 may secure the second end 22 of the drum 16 within the opening 32' of the second flange 14 up to a predetermined lateral force 78. However, it is understood this spool can be reused to mount yet another coil of cable (once the previous coil of cable has been paid out) by removing one or both of the first and second flanges 12, 14 from the drum 16 by exceeding the predetermined lateral force and overcoming the engagement force/connection between the tabs 34, 34', 36, 36' and the grooves 30', 30", 30'", 30"". Once at least one of the flanges 12, 14 has been removed, another coil of cable may be mounted to the drum 16, and the flanges 12, 14 may be reattached to the drum 16 for another use.

Figure 8A:
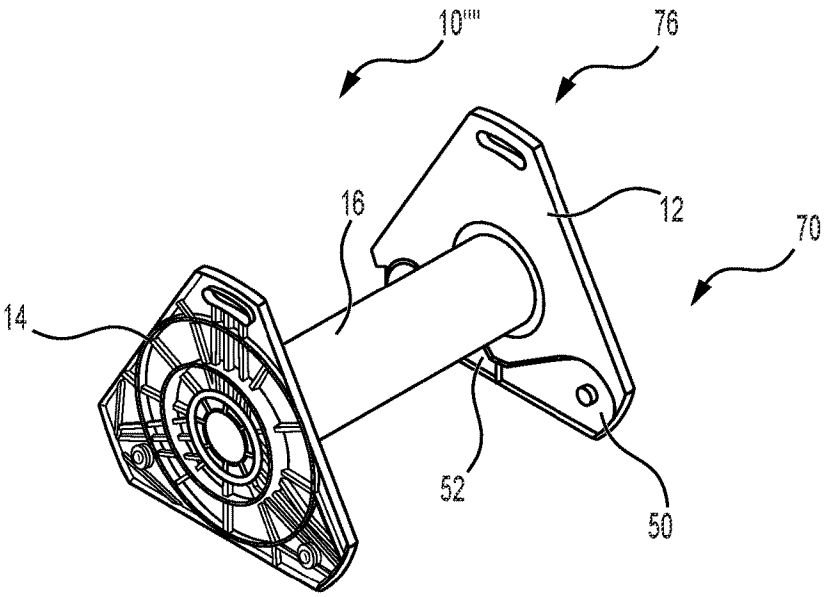
FIG. 8A is an isometric view of another exemplary embodiment of the present disclosure wherein the reusable spool includes pivotable legs in a stowed position.
Figure 8B:
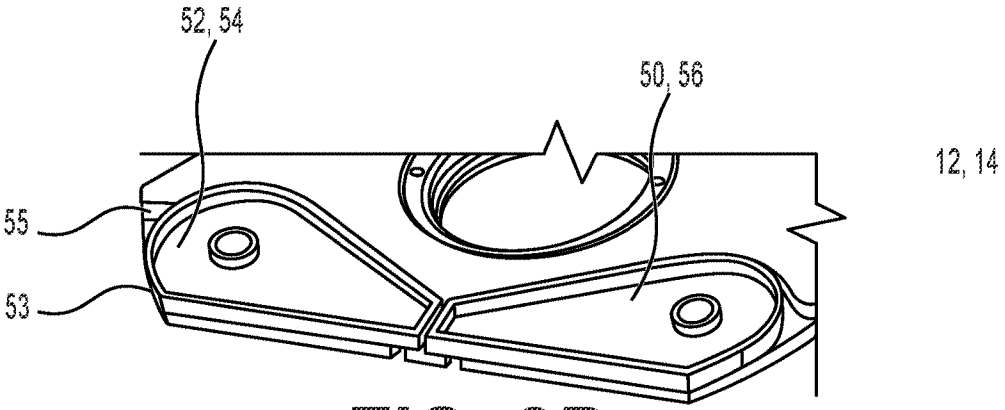
FIG. 8B is an enlarged view of the pivotable legs in FIG. 8A.
Figure 8C:
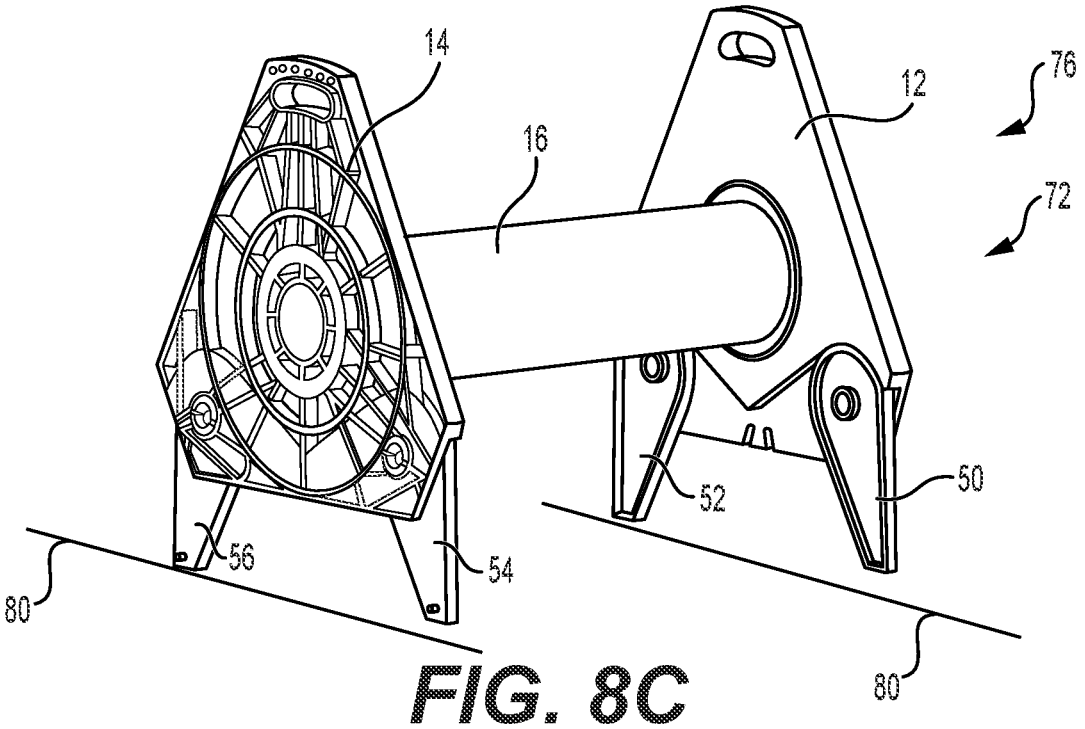
FIG. 8C is an isometric view of the reusable spool in FIG. 8A with the pivotable legs in the deployed position.
Figure 9A:
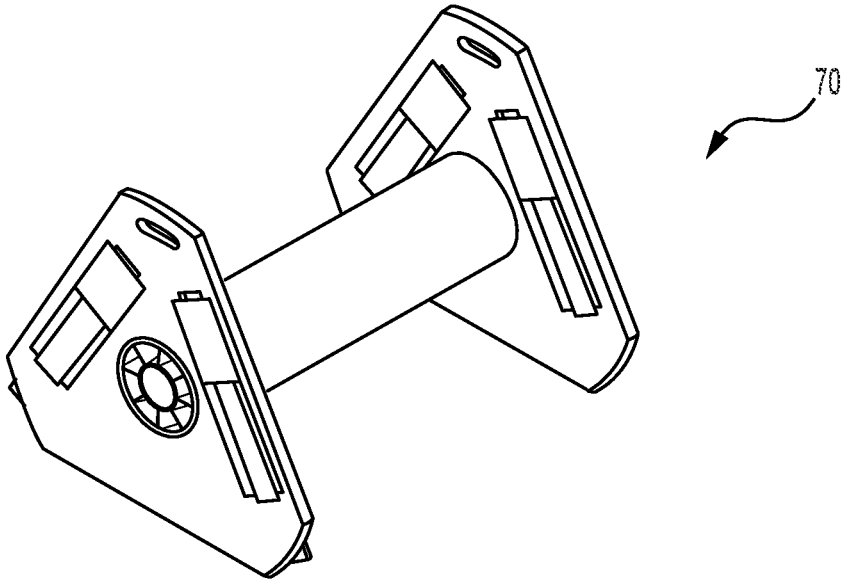
FIG. 9A is an isometric view of another example of the present disclosure wherein the reusable spool includes slidable legs in a stowed position.
Figure 9B:
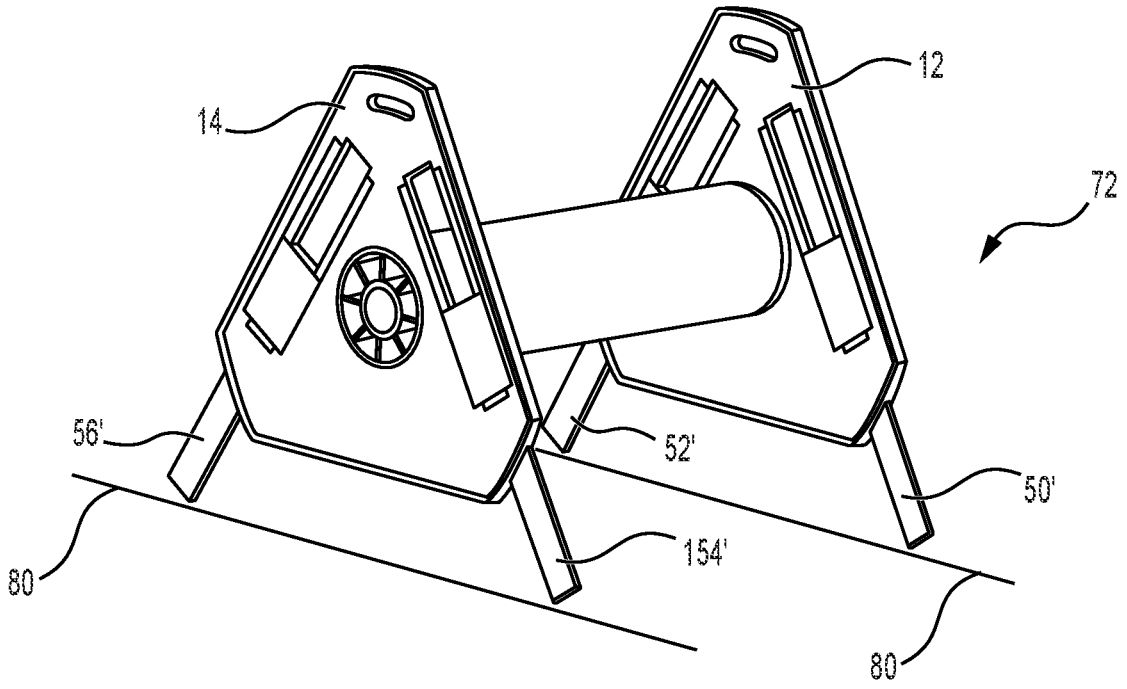
FIG. 9B is an isometric view of another example of the present disclosure wherein the reusable spool includes slidable legs in a deployed position.

Referring now to FIGS. 8A-9B, in yet another embodiment of the present disclosure, a reusable spool 10"" may include a first flange 12 having a first leg 50 and a second leg 52, a second flange 14 having a first leg 54 and a second leg 56, and a drum 16 configured to be disposed between the first flange 12 and the second flange 14. As shown in FIGS. 8A-9B, the first leg 50 and the second leg 52 of the first flange may be moveably coupled with the first flange 12. The first leg 54 and the second leg 56 of the second flange may be moveably coupled with the second flange 14. In this embodiment, the first legs 50, 54 and the second legs 52, 56 are each configured to move between a stowed position 70, as shown in FIGS. 8A and 9A, to a deployed position 72, as shown in FIGS. 8C and 9B. As shown in FIG. 8B and 8C, the outer edge 53 of each pivotable leg 50, 52, 54, 56 may abut flange surface 55 to hold each leg 50, 52, 54, 56 in the deployed position. However, it is understood that each second leg may optionally be integral to each flange such that the second leg is an extension of the flange thereby causing each flange to have an asymmetrical configuration. Under this optional arrangement, only the first leg would deploy and stow as described herein.

Nonetheless, where the first legs and the second legs move between a stowed position and a deployed position, it is understood that when the first legs 50, 54, the second legs 52, 56 are all in the deployed position 72, as shown in FIGS. 8C and 9B, the reusable spool 10"" also functions as a caddy 76 such that the first and second flanges 12, 14 and the drum are spaced above a ground level 80. Therefore, the reusable spool 10"" also includes an integrated caddy 76. When deployed, the legs engage the ground surface across a greater distance than the outer peripheral surfaces of the flanges engage when the legs are stowed. As such, the support base of the caddy is extended as compared with the flanges themselves. As a result, in the deployed position, the legs provide the caddy 76, i.e., the spool, with improved stability so as to prevent the spool from tipping during payout of the cable.

It is understood that, in one option, the first leg 50 and the second leg 52 of the first flange 12 may be pivotally attached to the first flange 12, as shown in FIGS. 8A-8C. Also, the first leg 54, and the second leg 56 of the second flange 14 may be pivotally coupled with the second flange 14. Alternatively, in yet another optional arrangement, the first leg 50 and the second leg 52 of the first flange 12 may be configured to slide relative to the first flange 12, and the first leg 54 and the second leg 56 of the second flange 14 may be configured to slide relative to the second flange 14, as shown in FIGS. 9A-9B. Therefore, under either of the foregoing arrangements, the first legs 50, 54 and the second legs 52, 56 each move between their stowed positions 70 and deployed positions 72. In one arrangement, the legs 50, 52, 54, 56 pivot out to their deployed positions 72 and pivot into their stowed positions 70, as shown in FIGS. 8A and 8C. In an alternate arrangement, the legs 50, 52, 54, 56 slide out to their deployed positions 72 and the legs 50, 52, 54, 56 slide into their stowed positions 70, as shown in FIGS. 9A and 9B.

In this exemplary embodiment, the drum 16 may optionally further define one or more nubs 26, 26' at each of the first end 18 of the drum 16 and at the second end 22 of the drum 16, as shown in FIGS. 3A-3C. The first flange 12 may also optionally further define one or more corresponding first recesses 20 and the second flange 14 may also optionally further define one or more corresponding second recesses 20', as shown in FIGS. 4 and 5A. Referring to FIGS. 3A-3C, each nub 26 at the first end 18 of the drum 16 may be configured to be at least partially disposed in a corresponding first recess 20 defined on the first flange 12. Similarly, each nub 26' at the second end 22 of the drum 16 may be configured to be at least partially disposed in a corresponding second recess 20' defined on the second flange 14. Similar to the previous embodiment, the nubs 26, 26' may alternatively be defined on the first and second flanges 12, 14, and the recesses 20 may be defined on each end of the drum 16. When each nub 26, 26' is at least partially disposed in a corresponding recess 20, 20', the drum 16 maintains rotationally fixed to the flanges 12, 14 up to a predetermined rotational force 68. However, once the predetermined rotational force 68 is exceeded, each nub 26, 26' may slide out of its corresponding recess 20, 20' into an adjacent channel 24, 24', until the nub 26 is further forced into yet another recess 20, 20'.

As indicated earlier, in this embodiment implementing an integrated caddy 76, the first legs 50, 54 and the second legs 52, 56 are each configured to move between a stowed position 70 and a deployed position 72. However, as indicated, when the first legs 50, 54 and the second legs 52, 56 are each in the deployed position 72, then the first and second flanges 12, 14 are spaced above a ground level 80 such that the drum 16, flanges 12, 14 and the legs 50, 52, 54, 56 function as an integrated drum 16 and caddy 76.

Figure 10B:
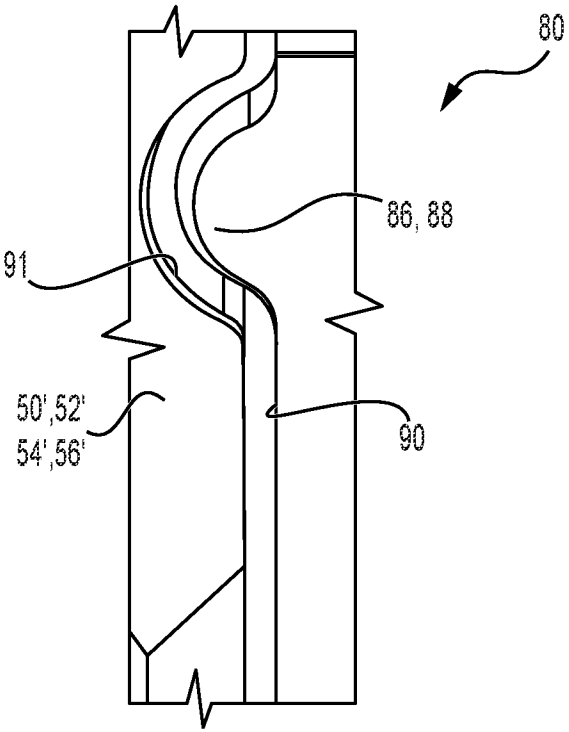
FIG. 10B is a cross-sectional view of each protrusion, recess, leg, and channel shown in FIG. 10A.
Figure 10A:
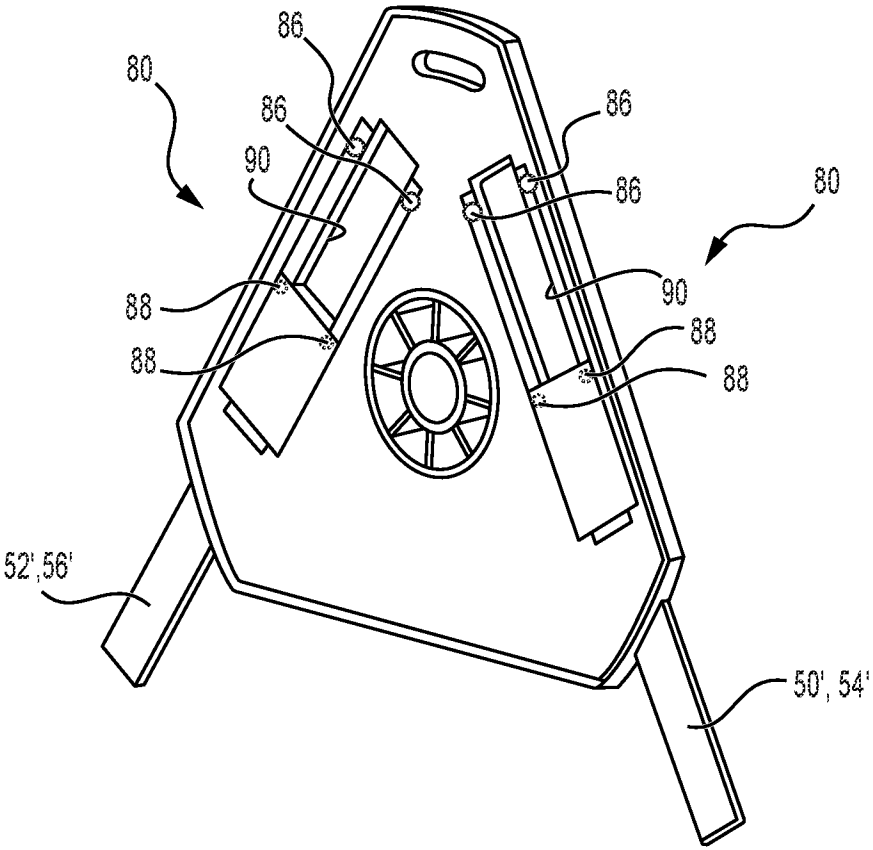
FIG. 10A is a view of an exemplary flange (first flange or second flange which has locking members in the form of protrusions).
Figure 10C:
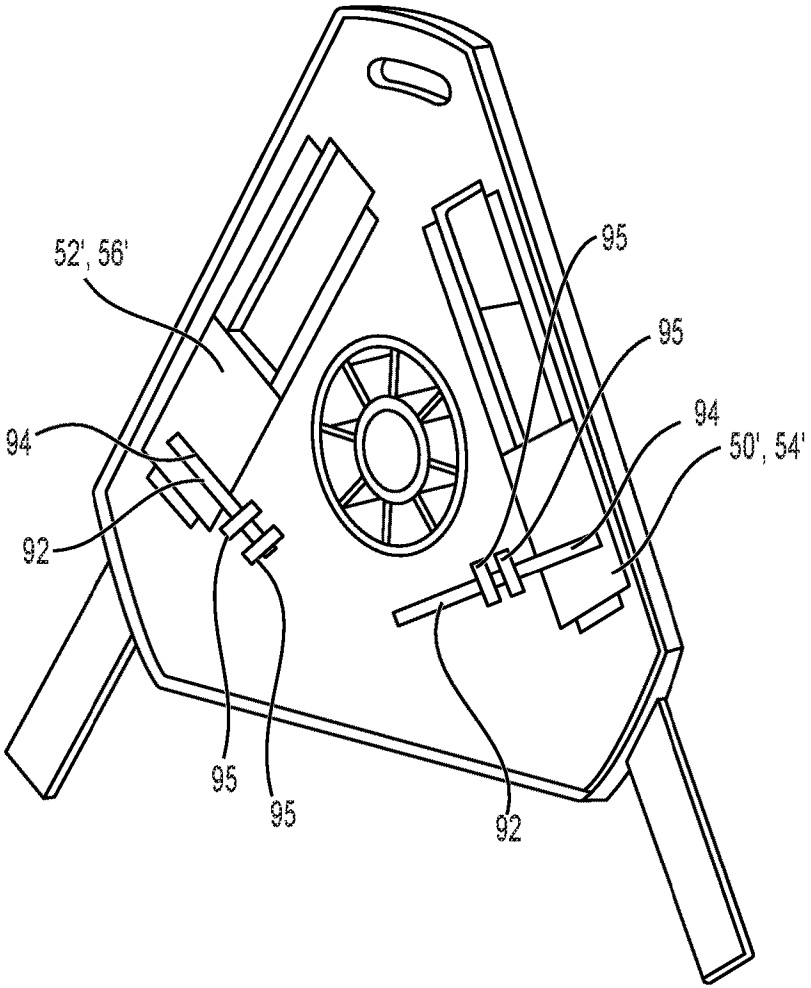
FIG. 10C is a view of an exemplary flange (first flange or second flange which has locking members in the form of protrusions).

Also, referring to FIGS. 10A-10C, of the present embodiment, a deployment locking member 80 for each of the first legs 50, 54 and each of the second legs 52, 56 may be implemented wherein each deployment locking member 80 is configured to maintain the deployed position 72 for each corresponding leg. Moreover, this exemplary reusable spool 10"" may also implement a stowing locking member 82 for each of the first legs 50, 54 and the second legs 52, 56 wherein each stowing locking member 82 is configured to maintain the stowed position 70 for each corresponding leg. The aforementioned locking members 80, 82 may be provided in various ways, including but not limited to: (1) stowing protrusions 86 and deployment protrusions 88 defined on each sliding leg channel 90 of each flange 12, 14, as shown in FIG. 10A, wherein each leg 50', 52', 54', 56' defines a cavity/recess 91 which is configured to receive the protrusions 86, 88 such that the engagement between the protrusions 86, 88 and the cavities/recesses 91 holds each leg 50', 52', 54', 56' in the deployment position or the stowed position; and (2) sliding stow locking members (not shown) and sliding deployment locking members 92, as shown in FIG. 10C, which are configured to engage with a corresponding channel 94 defined in each of the first legs 50, 54 and the second legs 52, 56. The locking members 92 may each be moveably affixed to the flange 12, 14 via a bracket 95 or the like.

In the various exemplary embodiments of the present disclosure, the drum 18 may define a bore 60 and the exterior surface 62 may also optionally be cored-out in order to reduce weight, as shown by way of example in FIGS. 1-7. Similarly, the flanges 12, 14 may also be cored-out at their exterior sides 64 as shown to also reduce weight. Moreover, the flanges 12, 14 of the present disclosure may be triangular as shown in the various figures or may be provided as traditionally round members. Also, as shown in all of the figures, the flanges 12, 14 also may also define one or more orifices 66 to reduce the weight. The orifices 66 may also be used as a handle to hold each flange 12, 14. Moreover, in the various embodiments of the present disclosure, the openings 32, 32' of the flanges 12 and 14 respectively may be provided in the form of an aperture, as shown in FIGS. 1-10, or as recess. With respect to the optional arrangement between the nubs 26, 26', the channels 24, 24' and the recesses 20, 20' in the various embodiments of the present disclosure, this arrangement enables a ratchetting rotation of the drum 16 relative to the flanges 12, 14 when the drum 16 is being coupled with the flanges 12, 14. Also, with respect to the various embodiments of the present disclosure, the drum 18 is configured to rotate relative to the first flange 12 and the second flange 14, and the first and second flanges 12, 14 are configured to be disposed on a substantially horizontal surface 80 (or ground level 80). Also, the first tab 34 and the second tab 34' configured to be integral with the drum 18.

While multiple non-limiting embodiments have been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A reusable spool for receiving a coil of cable and preventing tipping of the spool during payout of the cable from the coil comprising:

a cylindrical drum having a first end and a second end;

a first flange configured to be removably coupled with the first end of the drum;

a second flange configured to be removably coupled with the second end of the drum;

a first pair of legs movingly coupled with the first flange between a stowed position, where the first pair of legs are disposed within an outer periphery of the first flange, and a deployed position, where the first pair of legs are configured to extend beyond the outer periphery of the first flange;

a second pair of legs movingly coupled with the second flange between a stowed position, where the second pair of legs are disposed within an outer periphery of the second flange, and a deployed position, where the second pair of legs are configured to extend beyond the outer periphery of the second flange;

wherein the first flange and the second flange are configured to be removed from the drum to permit the drum to receive a coil of cable and to be coupled with the drum to retain the coil on the drum;

wherein the cylindrical drum is configured to receive the coil of cable and to permit the coil of cable to rotate relative to the cylindrical drum, the first flange, and the second flange;

wherein a portion of an outer peripheral surface of the first flange and a portion of an outer peripheral surface of the second flange are configured to engage a ground surface over a first distance when the first pair of legs and the second pair of legs are in the stowed position; and wherein the first pair of legs and the second pair of legs are configured to be moved to the deployed position to raise the drum, the first flange, and the second flange away from the ground surface to provide additional clearance for payout of the cable from the coil and to engage the ground surface over a second distance that is greater than the first distance to improve stability of the reusable spool so as to prevent the spool from tipping during payout of the cable.

2. The reusable spool of claim 1, wherein the first pair of legs are configured to pivot relative to the first flange between the stowed position and the deployed position, and the second pair of legs are configured to pivot relative to the second flange between the stowed position and the deployed position.

3. The reusable spool of claim 1, wherein a free end of each of the first pair of legs is configured to engage the ground surface where the free ends are separated by the second distance, and wherein a free end of each of the second pair of legs is configured to engage the ground surface where the free ends of the second pair of legs are separated by the second distance.

4. The reusable spool of claim 1, wherein the first pair of legs are configured to slide relative to the first flange between the stowed position and the deployed position, and the second pair of legs are configured to slide relative to the second flange between the stowed position and the deployed position.

5. The reusable spool of claim 1, wherein the first flange and the second flange are configured to be rotatingly fixed with the cylindrical drum during payout of the cable from the spool.

6. The reusable spool of claim 1, wherein the first flange includes first engagement features configured to maintain the first pair of legs in the stowed position, and wherein the second flange includes first engagement features configured to maintain the second pair of legs in the stowed position.

7. The reusable spool of claim 1, wherein the first flange includes second engagement features configured to maintain the first pair of legs in the deployed position, and wherein the second flange includes second engagement features configured to maintain the second pair of legs in the deployed position.

8. The spool of claim 1, wherein the first pair of legs and the second pair of legs are configured to be moved to the deployed position such that the first pair of legs and the second pair of legs are permitted to contemporaneously engage the ground surface over a second distance that is greater than the first distance to improve stability of the reusable spool so as to prevent the spool from tipping during payout of the cable.

9. A spool for receiving a coil of cable and preventing tipping of the spool during payout of the cable from the coil comprising:

a receiving member configured to receive a coil of cable and having a first end and a second end;

a first retaining member configured to be coupled with the first end of the receiving member;

a second retaining member configured to be coupled with the second end of the receiving member;

a first pair of support members movingly coupled with the first retaining member between a stowed position, where the first pair of support members are disposed within an outer periphery of the first retaining member, and a deployed position, where the first pair of support members are configured to extend beyond the outer periphery of the first retaining member;

a second pair of support members movingly coupled with the second retaining member between a stowed position, where the second pair of support members are disposed within an outer periphery of the second retaining member, and a deployed position, where the second pair of support members are configured to extend beyond the outer periphery of the second retaining member;

wherein the first retaining member or the second retaining member is configured to be removed from the receiving member to permit the receiving member to receive a coil of cable;

wherein a portion of an outer peripheral surface of the first retaining member and a portion of an outer peripheral surface of the second retaining member are configured to engage a ground surface across a first distance when the first pair of support members and the second pair of support members are in the stowed position; and wherein the first pair of support members and the second pair of support members are configured to be moved to the deployed position to engage the ground surface across a second distance that is greater than the first distance to improve stability of the reusable spool so as to prevent the spool from tipping during payout of the cable.

10. The spool of claim 9, wherein at least one of the first retaining member and the second retaining member is configured to be removably coupled with the first end and the second end of the receiving member, respectively, to permit the spool to be reused.

11. The spool of claim 9, wherein the first pair of support members are configured to pivot relative to the first retaining member between the stowed position and the deployed position, and the second pair of support members are configured to pivot relative to the second retaining member between the stowed position and the deployed position.

12. The spool of claim 9, wherein a free end of each of the first pair of support members is configured to engage the ground surface where the free ends are separated by the second distance, and wherein a free end of each of the second pair of support members is configured to engage the ground surface where the free ends of the second pair of support members are separated by the second distance.

13. The spool of claim 9, wherein the first pair of support members are configured to slide relative to the first retaining member between the stowed position and the deployed position, and the second pair of support members are configured to slide relative to the second retaining member between the stowed position and the deployed position.

14. The spool of claim 9, wherein the first retaining member and the second retaining member are configured to be rotatingly fixed with the receiving member during payout of the cable from the spool.

15. The spool of claim 9, wherein the receiving member comprises a drum.

16. The spool of claim 9, wherein the drum comprises a cylindrical drum.

17. The spool of claim 9, wherein the first retaining member and the second retaining member each comprise a flange.

18. The spool of claim 9, wherein the first pair of support members and the second pair of support members comprise legs.

19. The spool of claim 9, wherein the first retaining member includes first engagement features configured to maintain the first pair of support member-members in the stowed position, and wherein the second retaining member includes first engagement features configured to maintain the second pair of support members in the stowed position.

20. The spool of claim 9, wherein the first retaining member includes second engagement features configured to maintain the first pair of support members in the deployed position, and wherein the second retaining member includes second engagement features configured to maintain the second pair of support members in the deployed position.

21. The spool of claim 9, wherein the first pair of support members and the second pair of support members are configured to be moved to the deployed position such that the first pair of support members and the second pair of support members are permitted to contemporaneously engage the ground surface across the second distance that is greater than the first distance to improve stability of the reusable spool so as to prevent the spool from tipping during payout of the cable.

22. A spool for receiving a coil of cable and preventing tipping of the spool during payout of the cable from the coil comprising:

a receiving portion configured to receive a coil of cable;

a first retaining portion and a second retaining portion configured to retain the coil of cable on the receiving portion;

wherein a portion of an outer peripheral surface of the first retaining portion and a portion of an outer peripheral surface of the second retaining portion are configured to engage a ground surface across a first distance;

wherein the first retaining portion includes first support portions configured to extend beyond the outer peripheral surface of the first retaining portion to engage the ground surface across a greater distance than the first distance, and the second retaining portion includes second support portions configured to extend beyond the outer peripheral surface of the second retaining portion to engage the ground surface across a greater distance than the first distance to improve stability of the reusable spool so as to prevent the spool from tipping during payout of the cable.

23. The spool of claim 22, wherein at least one of the first retaining portion and the second retaining portion is configured to be removably coupled with the first end and the second end of the receiving portion, respectively, to permit the spool to be reused.

24. The spool of claim 22, wherein the first pair of support portions are configured to pivot relative to the first retaining portion between the stowed position and the deployed position, and the second pair of support portions are configured to pivot relative to the second retaining portion between the stowed position and the deployed position.

25. The spool of claim 22, wherein a free end of each of the first pair of support portions is configured to engage the ground surface where the free ends are separated by the greater distance, and wherein a free end of each of the second pair of support portions is configured to engage the ground surface where the free ends of the second pair of support portions are separated by the greater distance.

26. The spool of claim 22, wherein the first pair of support portions are configured to slide relative to the first retaining portion between the stowed position and the deployed position, and the second pair of support portions are configured to slide relative to the second retaining portion between the stowed position and the deployed position.

27. The spool of claim 22, wherein the first retaining portion and the second retaining portion are configured to be rotatingly fixed with the receiving portion during payout of the cable from the spool.

28. The spool of claim 22, wherein the receiving portion comprises a drum.

29. The spool of claim 22, wherein the drum comprises a cylindrical drum.

30. The spool of claim 22, wherein the first retaining portion and the second retaining portion each comprise a flange.

31. The spool of claim 22, wherein the first pair of support portions and the second pair of support portions comprise legs.

32. The spool of claim 22, wherein the first retaining portion includes first engagement features configured to maintain the first pair of support portions in a stowed position, and wherein the second retaining portion includes first engagement features configured to maintain the second pair of support portions in a stowed position.

33. The spool of claim 22, wherein the first retaining portion includes second engagement features configured to maintain the first pair of support portions in an extended position, and wherein the second retaining portion includes second engagement features configured to maintain the second pair of support portions in an extended position.

34. The spool of claim 22, wherein the first support portions are configured to extend beyond the outer peripheral surface of the first retaining portion such that the first support portions are permitted to contemporaneously engage the ground surface across the greater distance than the first distance, and the second support portions are configured to extend beyond the outer peripheral surface of the second retaining portion such that the first support portions are permitted to contemporaneously engage the ground surface across a greater distance than the first distance to improve stability of the reusable spool so as to prevent the spool from tipping during payout of the cable.

* * * * *